US009302285B2

(12) United States Patent
Marbet et al.

(10) Patent No.: US 9,302,285 B2
(45) Date of Patent: Apr. 5, 2016

(54) LIQUID DISPENSING SYSTEM

(75) Inventors: Regina Marbet, Ruetchschelen (CH); Alexandre Perrier, Liestal (CH)

(73) Assignee: SENSILE PAT AG, Haegendorf (CH)

( * ) Notice: Subject to any disclaimer, the term of this patent is extended or adjusted under 35 U.S.C. 154(b) by 146 days.

(21) Appl. No.: 14/130,692

(22) PCT Filed: Jul. 3, 2012

(86) PCT No.: PCT/IB2012/053366

§ 371 (c)(1),
(2), (4) Date: Jan. 3, 2014

(87) PCT Pub. No.: WO2013/005159

PCT Pub. Date: Jan. 10, 2013

(65) Prior Publication Data

US 2014/0138410 A1 May 22, 2014

(30) Foreign Application Priority Data

Jul. 6, 2011 (CH) ..... 1130/11

(51) Int. Cl.
*B67D 7/66* (2010.01)
*B05B 11/00* (2006.01)
(Continued)

(52) U.S. Cl.
CPC ..... *B05B 11/3042* (2013.01); *B05B 11/3001* (2013.01); *B05B 11/3052* (2013.01);
(Continued)

(58) Field of Classification Search
CPC ..... B05B 11/0037; B05B 11/3047; B05B 11/3042; B05B 11/3052; B05B 11/3001; B05B 11/3091; B05B 11/3094; F04B 7/06; F04B 9/14; F04B 19/006
USPC ..... 222/153.13, 336, 383.2, 385, 404, 505, 222/509, 384
See application file for complete search history.

(56) References Cited

U.S. PATENT DOCUMENTS 1,972,410 A * 9/1934 Siemen et al. ..... 222/383.2
4,232,828 A * 11/1980 Shelly, Jr. ..... 239/329
(Continued)

FOREIGN PATENT DOCUMENTS

DE 102004036555 3/2005
EP 2383045 11/2011
(Continued)

OTHER PUBLICATIONS

Written Opinion in International Application No. PCT/IB2012/053366, Nov. 23, 2012, pp. 1-6.

*Primary Examiner* — Patrick M Buechner
(74) *Attorney, Agent, or Firm* — Saliwanchik, Lloyd & Eisenschenk

(57) ABSTRACT

A manually energized dispensing system containing a dispensing head (1) which has a housing (2), a nozzle, a pump (4) mounted in the housing, and a pump actuation mechanism (3) is provided. The pump has a pump rotor (13) and a stator (12). The pump rotor has two axial extensions (17, 18) of different diameters, mounted in corresponding chambers (15, 16) of the stator, and first and second seals (19, 20) mounted in the stator housing and surrounding the first and second axial rotor extensions. The rotor extensions comprising liquid supply channels (22, 24), in conjunction with the seals operate as valves that open and close communication between an inlet of the pump connected to the inside of a container (7) and the pump chambers, respectively. The pump chambers are operated as a function of the angular displacement of the pump rotor.

19 Claims, 7 Drawing Sheets

(51) Int. Cl.
*F04B 7/06* (2006.01)
*F04B 9/14* (2006.01)
*F04B 19/00* (2006.01)

(52) U.S. Cl.
CPC ..... *B05B11/3091* (2013.01); *B05B 11/3094* (2013.01); *F04B 7/06* (2013.01); *F04B 9/14* (2013.01); *F04B 19/006* (2013.01); *B05B 11/0037* (2013.01); *B05B 11/3047* (2013.01)

(56) References Cited

U.S. PATENT DOCUMENTS

| | | | | |
|---|---|---|---|---|
| 4,260,082 | A | 4/1981 | Rooney et al. | |
| 4,767,033 | A * | 8/1988 | Gemperle | 222/383.2 |
| 5,839,621 | A * | 11/1998 | Tada | 222/383.1 |
| 2004/0050875 | A1 * | 3/2004 | Kobayashi | 222/333 |
| 2005/0132879 | A1 | 6/2005 | Grollimund et al. | |
| 2007/0071596 | A1 * | 3/2007 | Ryser et al. | 415/172.1 |
| 2008/0029620 | A1 | 2/2008 | Hillhouse et al. | |
| 2009/0114674 | A1 | 5/2009 | Chou | |
| 2009/0114683 | A1 * | 5/2009 | Chou | 222/383.1 |
| 2009/0123309 | A1 * | 5/2009 | Hilber et al. | 417/417 |

FOREIGN PATENT DOCUMENTS

| | | |
|---|---|---|
| GB | 2291135 | 1/1996 |
| WO | WO 2005/039674 | 5/2005 |

* cited by examiner

Fig. 7c
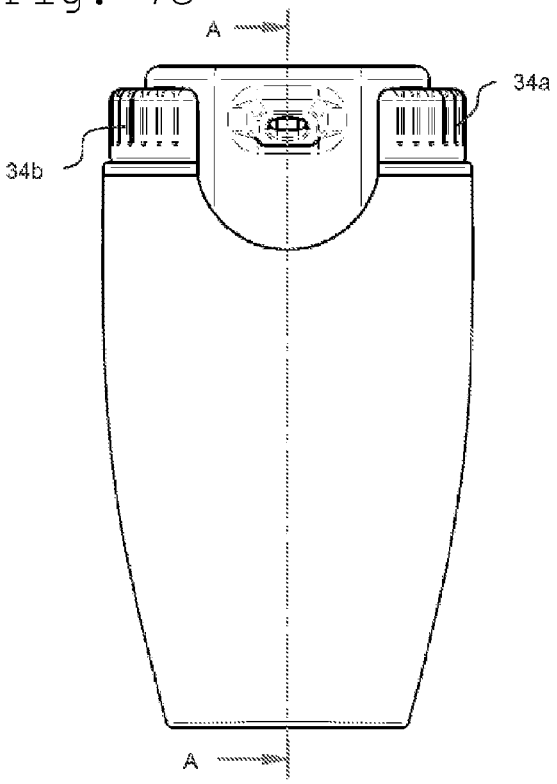
Fig. 7d
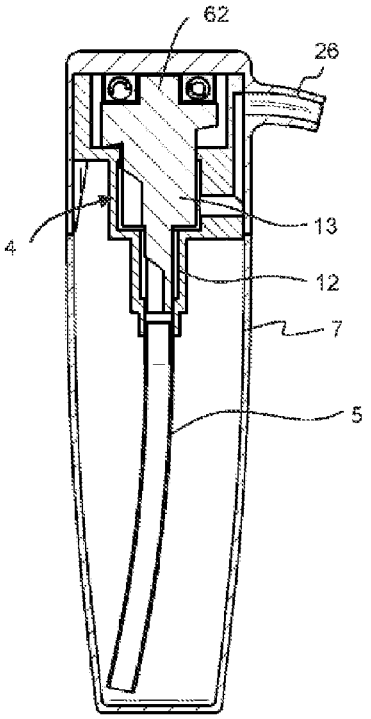
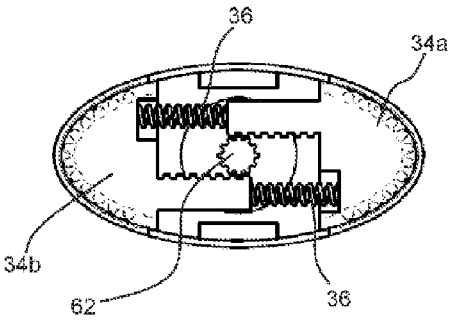
Fig. 7e
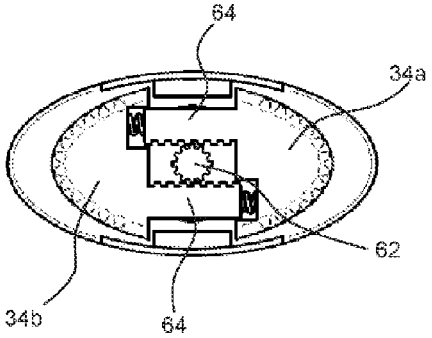
Fig. 7f

LIQUID DISPENSING SYSTEM

CROSS-REFERENCE TO RELATED APPLICATION

This application is the U.S. national stage application of International Patent Application No. PCT/IB2012/053366, filed Jul. 3, 2012.

The present invention relates to a mechanical dispensing system for dispensing fluids.

There are generally two categories of dispensing systems: pressurized and non pressurized. In pressurized systems, containers are filled with gas under pressure, the gas either being mixed with the liquid to be dispensed, or separated therefrom by a bag receiving the liquid or gel mounted in a pressure resistant container, the bag being connected to the outlet valve and the pressurized gas surrounding the bag within the container. The liquid is dispensed by actuating the valve. A disadvantage of pressurized systems is the need to have a sufficiently resistant container to withstand the pressure of the propellant. Also, the use of volatile propellants such as butane is unfriendly to the environment and hazardous in view of their inflammability. The nature of the recipients that may be used in pressurized systems is also limited due to the technical constraints.

In mechanically pressurized systems, pumping ambient air into the container to pressurize the container before use may not be appropriate for certain liquids and gels to be dispensed because of the oxidizing effect and the introduction of bacteria contained in the air into the container.

Certain dispensers comprise a membrane or piston pump that directly pumps the liquid in the container out of the dispensing head nozzle. Conventional dispensing heads however do not allow a fine and accurate delivery of liquid and the rate of delivery of the liquid being dispensed is highly dependent on the force applied by the user on the actuator lever. In conventional systems, even after the pumping action has been stopped, there is often still a small amount of liquid that continues to exit the dispensing head outlet nozzle. In direct pump action dispensers, it is also very difficult to generate a consistent aerosol spray, in particular a consistent droplet size and rate of delivery. Conventional direct action dispensing pumps are also cumbersome and not very compact. For many products, conventional direct action dispensing pumps are not very elegant and find limited use in products that seek a large customer appeal, for example in cosmetics products.

It is an object of this invention to have a dispensing system for a container receiving a fluid that is manually energised and that enables a well controlled and consistent delivery of fluid.

For certain applications it is advantageous to provide a manually actuated fluid dispensing head that can dispense small quantities of fluid with fine control.

For certain applications it is advantageous to provide a manually actuated fluid dispensing head that can dispense fluid in an aerosol spray with consistent rate of delivery and droplet size.

For certain applications it is advantageous to provide a manually actuated fluid dispensing head that can be implemented in containers that do not pump or draw air into the liquid contained in the container.

For certain applications it is advantageous to provide a manually actuated fluid dispensing head that can be integrated within a container in a discrete manner and that allows a wide range of container design configurations.

It is advantageous to provide a manually actuated fluid dispensing head that is compact and cost-effective.

It is advantageous to provide a manually actuated dispensing head that is easy to operate.

Objects of this invention have been achieved by providing a manually actuated dispensing system.

Disclosed herein is a manually actuated dispensing system for dispensing a fluid contained in a non-pressurized container, the dispensing system comprising a nozzle through which fluid to be dispensed exits, a dispensing head comprising a housing, a pump mounted in the housing, and a pump actuation mechanism. The pump comprises a rotor rotatably and axially displaceable with respect to a stator, the rotor comprising first and second axial extensions of different diameters, mounted in corresponding chambers of the stator, first and second seals mounted in the stator housing and surrounding the first and second axial rotor extensions, the rotor extensions comprising liquid supply channels that, in conjunction with the sealing rings, operate as valves that open and close communication between an inlet of the pump connected to the inside of the container and the pump chambers, respectively the pump chambers and an outlet of the pump connected to the dispensing nozzle, as a function of the angular displacement of the pump rotor. The rotor is coupled mechanically to the actuation mechanism and the actuation mechanism is configured to be manually operated to release or to drive the pump rotor to dispense fluid, respectively to block the pump rotor to stop dispensing fluid.

The rotor and stator may comprise complementary cam mechanisms defining the axial displacement of the rotor in opposing axial directions as a function of angular displacement of the rotor, the axial directions defining a pumping action and a pump filling action.

According to certain embodiments, the dispensing system may further comprise an energy storage mechanism coupled to the pump rotor, and a manually actuable energy storage loading mechanism coupled to the energy storage mechanism.

The energy storage mechanism may advantageously comprise a spiral spring coupled at an inner end to a rotor portion coupled to the pump rotor, and at an outer end to a housing portion fixed to, or integral with, the dispenser head housing. The spring may be coupled to the pump rotor via a freewheel allowing free rotation of the rotor portion during loading of the spring respectively locking the rotor portion to the pump rotor during unloading of the clock spring.

The loading mechanism may comprise a manual loading grip in the form of a wheel grip rotatably mounted to the housing configured to wind up the spring.

In another embodiment, the loading mechanism may comprise a cord coupled at one end to the rotor portion and windable therearound, and connected at the other end to a handle, the cord being pullable to wind the spring.

The pump actuation mechanism may advantageously comprise a brake member engagable with a complementary brake portion of the pump rotor configured to block the rotor when the actuation mechanism is in a position to stop dispensing fluid, respectively release the pump rotor when the actuation mechanism is in a position to dispense fluid. The brake member and complementary brake portion may comprise interengaging teeth or protrusions, or may function principally by friction grip.

The pump actuation mechanism may comprise a spring configured to elastically bias the brake member towards the complementary brake portion to block the rotor when the actuation mechanism is released.

In certain embodiments, the actuation mechanism may be coupled to the pump rotor in a manner configured to directly drive the pump rotor to dispense fluid during manual actuation of the actuation mechanism. The pump rotor may be coupled to a gear wheel engaged by a complementary gear of the pump actuation mechanism, the complementary gear being actuated by a manual actuation member of the pump actuation mechanism. The gear wheel may be coupled to the pump rotor via a freewheel.

The complementary gear of the pump actuation mechanism may be in the form of a rack or in the foam of a gear wheel or gear ring.

In certain embodiments, the pump may advantageously be disposed inside the container, for instance proximate or at a bottom wall of the container, and at least partially immersed in fluid contained in the container.

Advantageously, the invention provides a dispensing head that allows a consistent rate of the liquid to be dispensed, the dispensing rate depending not on a variation of actuation force but on the rotation speed of the pump rotor that may be well-controlled. The dosage controlled by rotation of the pump which also acts as a valve obviates the need for a separate dispensing valve.

In certain embodiments, an energy storage means, such as a coil spring or other springs that are energized and used to drive the rotor of the pump enable a dispensing operation without creating pressure in the container and without requiring a pumping action during the liquid dispensing. For the dispensing of small amounts of liquids, this is advantageous for comfort of use and for accurately directing the dispensing head and the fluid to be dispensed.

Also advantageously, the dispensing head according to the invention can be used in very small containers that have no or little gas therein, or that do not accept the pumping of ambient air into the container.

Further objects and advantageous features of the invention will be apparent from the claims, the detailed description, and the annexed drawings, in which:

Figure 5A:
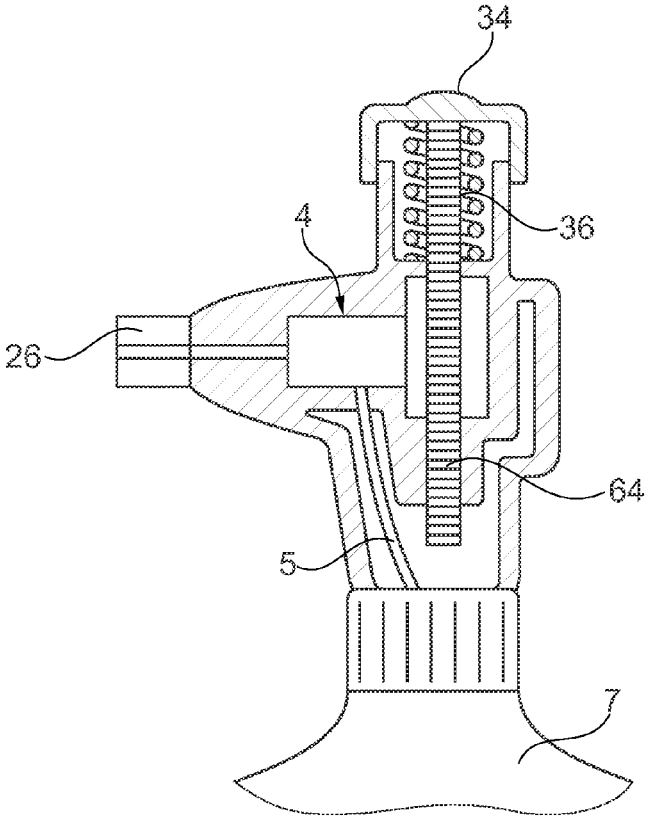
Figure 5B:
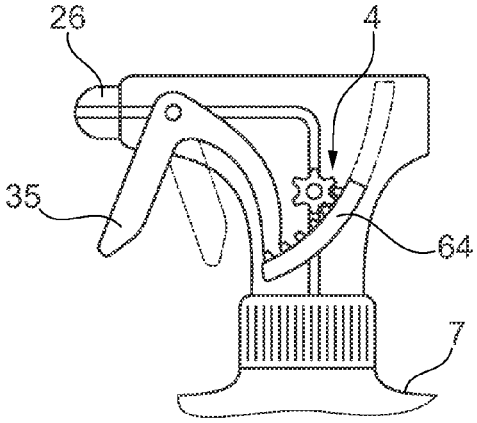
Figure 5C:
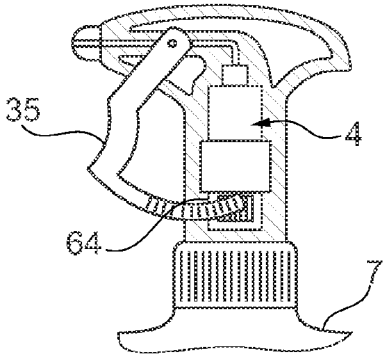
Figure 6A:
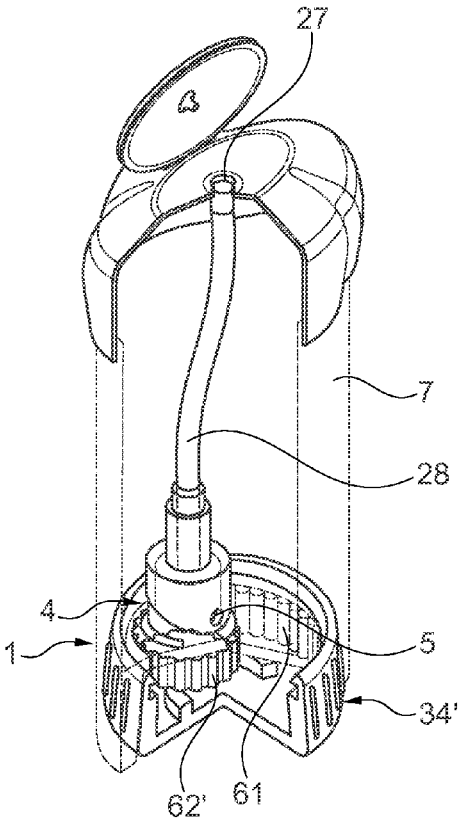
Figure 6B:
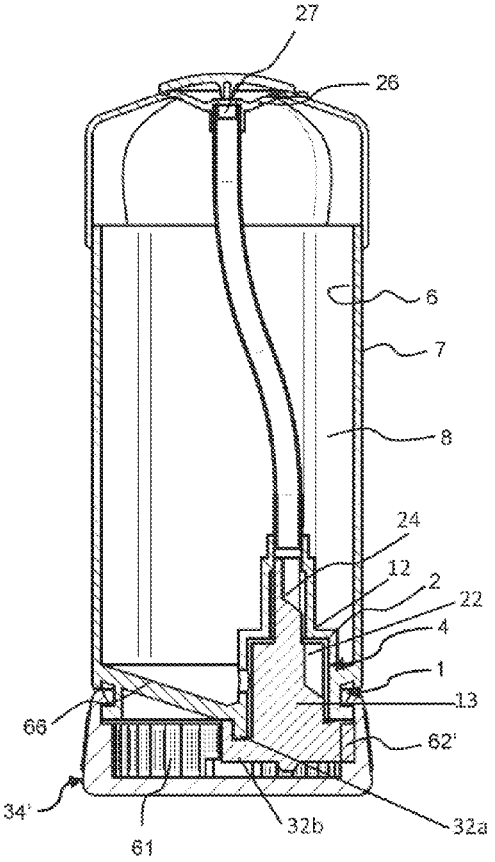
Figure 7A:
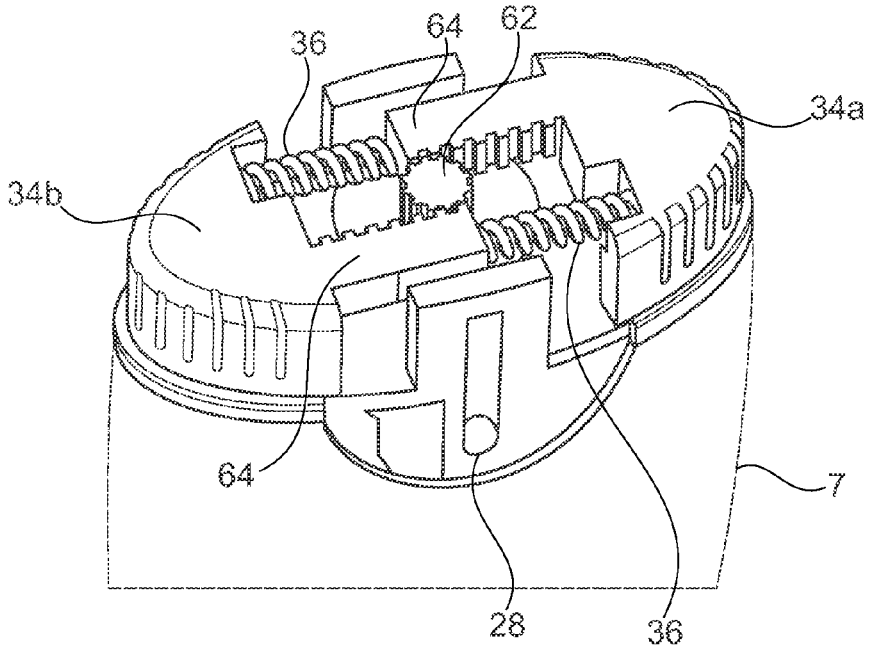
Figure 7B:
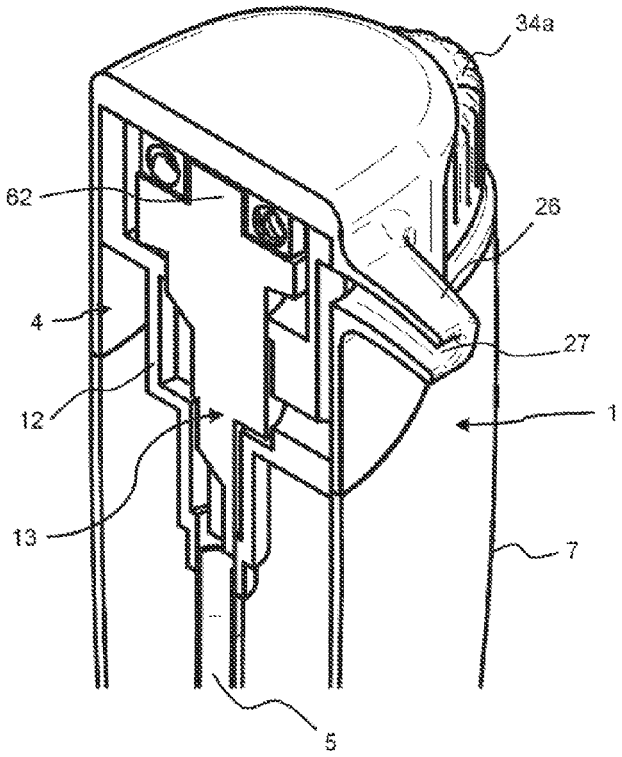

FIGS. 5*a*, 5*h* and 5*c* are schematic cross-sectional views through variants of a dispenser head according to a fifth embodiment of the invention;

FIGS. 6*a* and 6*b* are cross-sectional views through a dispenser system according to a sixth embodiment of the invention; and FIGS. 7*a* to 7*f* are views of a dispenser system according to a seventh embodiment of the invention, FIG. 7*a* illustrating in perspective a top end of the dispensing system with a top cover part removed, FIG. 7*b* illustrating in perspective a cross-sectional view through a top end of the dispensing system, FIG. 7*c* illustrating a plain front view, FIG. 7*d* illustrating a cross-sectional view through line A-A of FIG. 7*c*, and FIGS. 7*e* and 7*f* illustrating the top end, showing the actuation mechanism in an un-actuated, respectively actuated position.

Referring to the figures, a non-pressurized mechanically actuated dispensing system according to various embodiments of the invention comprises in general a dispensing mechanism including a dispensing head 1 comprising a body or housing 2, an actuation mechanism 3, and a pump 4 connected to an inlet 5 communicating with the inside of a liquid reservoir 6 of a container 7 in which a fluid to be dispensed 8 is contained. In certain embodiments, the dispensing head may further comprise an energy storage mechanism 9 and a loading mechanism 10 for energising the energy storage mechanism 9.

The pump 4 may advantageously have a configuration and pumping action similar to the pump described in WO2007/074363, which is incorporated herein by reference, except for differences described herein. The pump 4 comprises a stator 12 and a rotor 13 rotatably mounted in the stator. The stator 12 comprises a housing 14 defining a chamber 15, 16, hereinafter called the rotor chamber, within which first and second axial extensions 17, 18 of the rotor are mounted. First and second seals 19, 20 are mounted in the stator housing 14 and define sealing rings sealingly surrounding the first and second axial extensions 17, 18 respectively of the rotor. Liquid supply channels 22, 24 are provided in the first and second axial extensions of the rotor. The first axial rotor extension 17 has a generally cylindrical shape with a diameter D1 that is smaller than the diameter D2 of the second axial extension 18 which also has a generally cylindrical shape. The axial extensions with liquid supply channels cooperate with the respective first and second seals to create first and second valves that open and close liquid communication across the respective seal as a function of the angular displacement of the rotor.

In a preferred embodiment, the axial movement of the rotor 13 is advantageously effected by a double cam mechanism 30 that defines the axial displacement of the rotor in both axial directions, namely in the pumping action direction A1 and in the pump filling direction A2, as a function of the rotor angular displacement. The cam mechanism 30 comprises a rotor cam 31 and a stator cam comprised of 32*a* and 32*b*. The rotor cam may be in the form of one or more protrusions and the stator cam in the form of annular cam surfaces 32*a*, 32*b*, a first cam surface 32*a* defining the pumping action and an opposed cam surface 32*b* defining the pump filling action (i.e. drawing of fluid into the pump). It is understood however that the cam mechanism may be inversed in that the rotor provides the annular cam surfaces and the stator first and second cam protrusions either side of the rotor annular cam. The above-described double cam mechanism is advantageous in that the cam elements may be manufactured of injected plastic or other materials and assembled or integrally formed with the rotor, respectively stator of the pump, in a very cost effective configuration.

Figure 1:
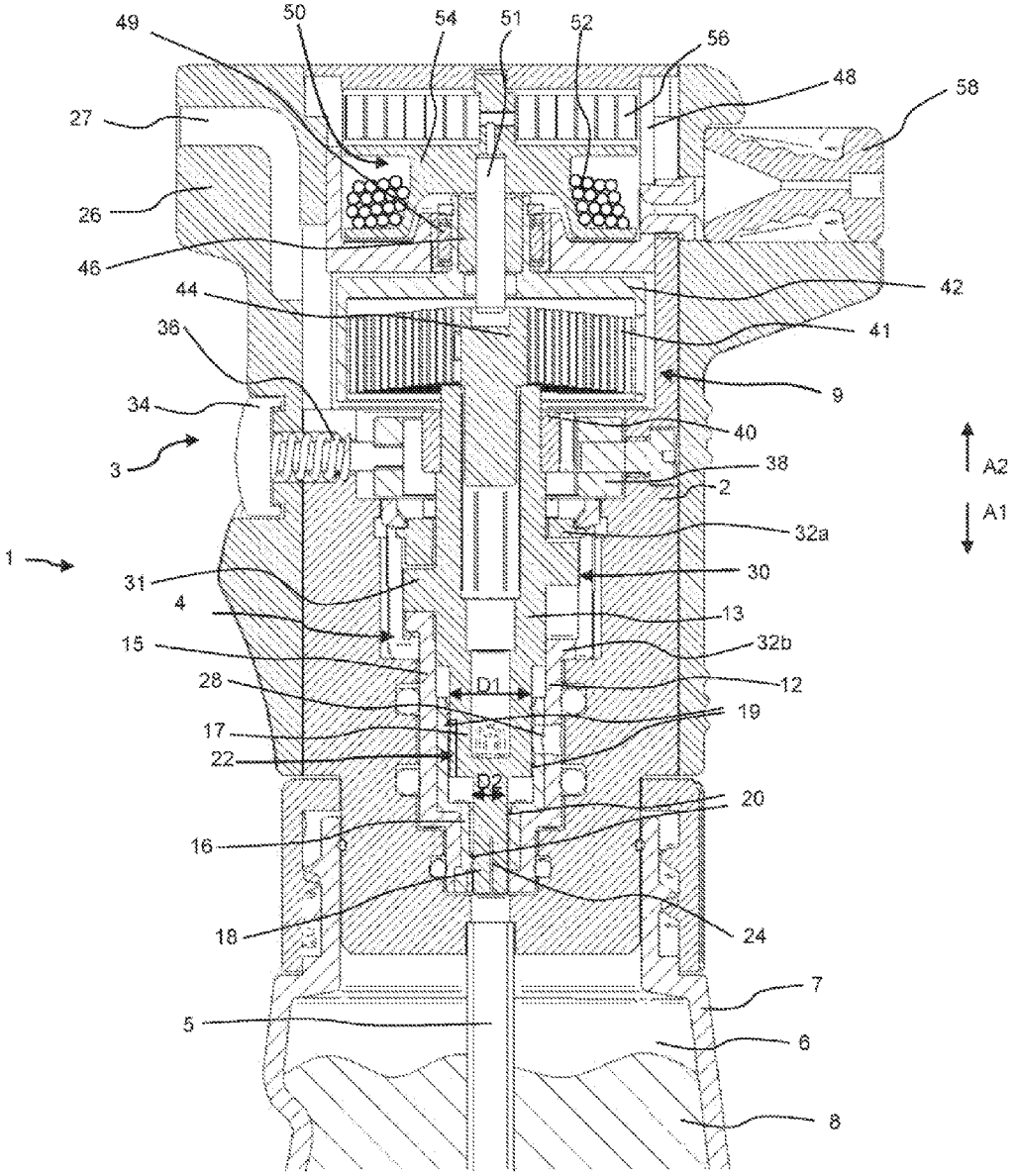
FIG. 1 is a cross-sectional view through a spray dispensing head according to a first embodiment of the invention.

The stator 12 of the pump is illustrated in FIG. 1 as a separate component from the housing 2 of the dispenser head 1. The stator 12 may however advantageously be directly formed and integral with the dispenser head housing 2, thus reducing the number of components and cost of the dispenser head.

The outlet 28 of the pump communicates with an outlet 27 of a nozzle 26 of the dispenser head. The pump outlet may advantageously connect directly to the nozzle 26, but within the scope of the invention it is also possible, if desired, to position a valve, such as a self-closing valve or a manually actuated valve, between the pump outlet 28 and nozzle outlet 27.

It is understood that within the meaning of the term "fluid" as used herein, it is meant any liquid, gel, suspension, cream, or other product that flows and may be dispensed by a pumping action, either sprayed as an aerosol or dispensed as a non-aerosol liquid or gel. The invention may advantageously be used for a large range of liquid products including cosmetics, liquid soaps, liquid medical preparations and formulations, detergents, water and other liquids without any specific limitations. The actual design of the nozzle outlet for creating an aerosol spray, or foam such a shaving cream, or delivering a flowing fluid may use designs per se known from the various conventional dispensing heads.

The use of a pump as described herein in a fluid dispensing system is particularly advantageous for a number of reasons. Firstly, the pump can draw liquid from a container at sub-atmospheric pressures, in other words creating a partial volume, which allows the liquid contained in the reservoir to be drawn out without replacing the volume of dispensed fluid that exits the reservoir with ambient air. The amount of fluid dispensed depends only on the number of turns effected by the rotor of the pump and not on the pressure difference between the liquid reservoir and ambient pressure, nor on the resistance to flow of dispensed liquid in the pump or outlet nozzle. Also, the pump used in the present invention enables accurate dosage of the dispensed liquid and obviates the need for valves since the pump itself integrates a valve function. Also, the pump used herein may be easily integrated in a dispensing spray head, or within a liquid container as illustrated in the embodiments of FIGS. 7*a* to 7*f*, in a compact and economical manner. The various illustrated embodiments may all comprise the above-described general or common features and these features will thus not be repeated in detail with respect to the various illustrated embodiments.

Figure 2:
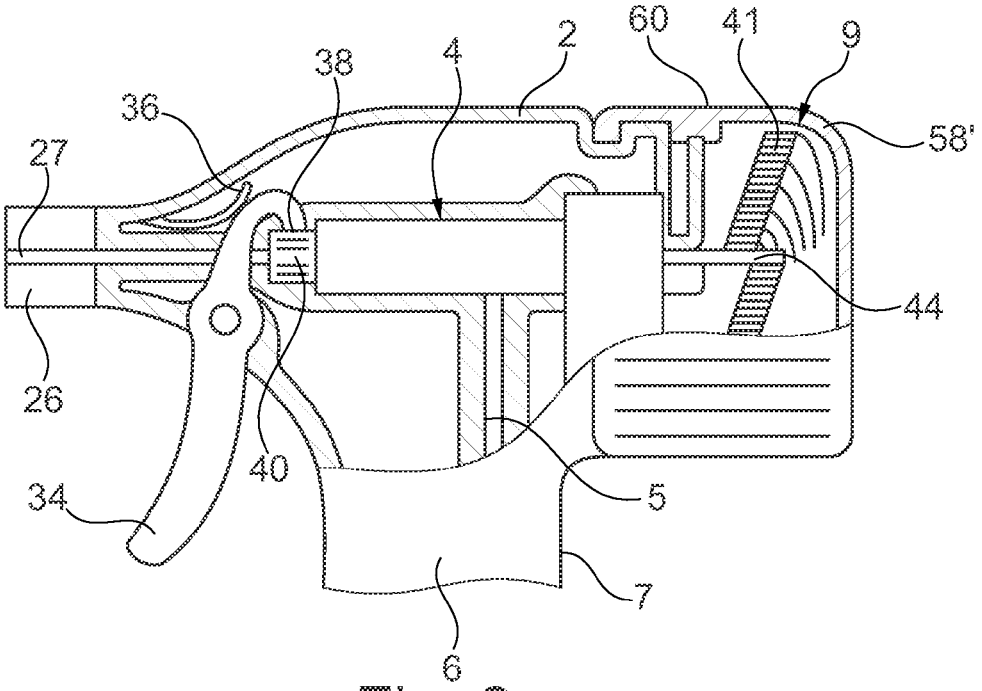
FIG. 2 is a schematic cross-sectional view through a dispenser head according to a second embodiment of the invention.
Figure 3:
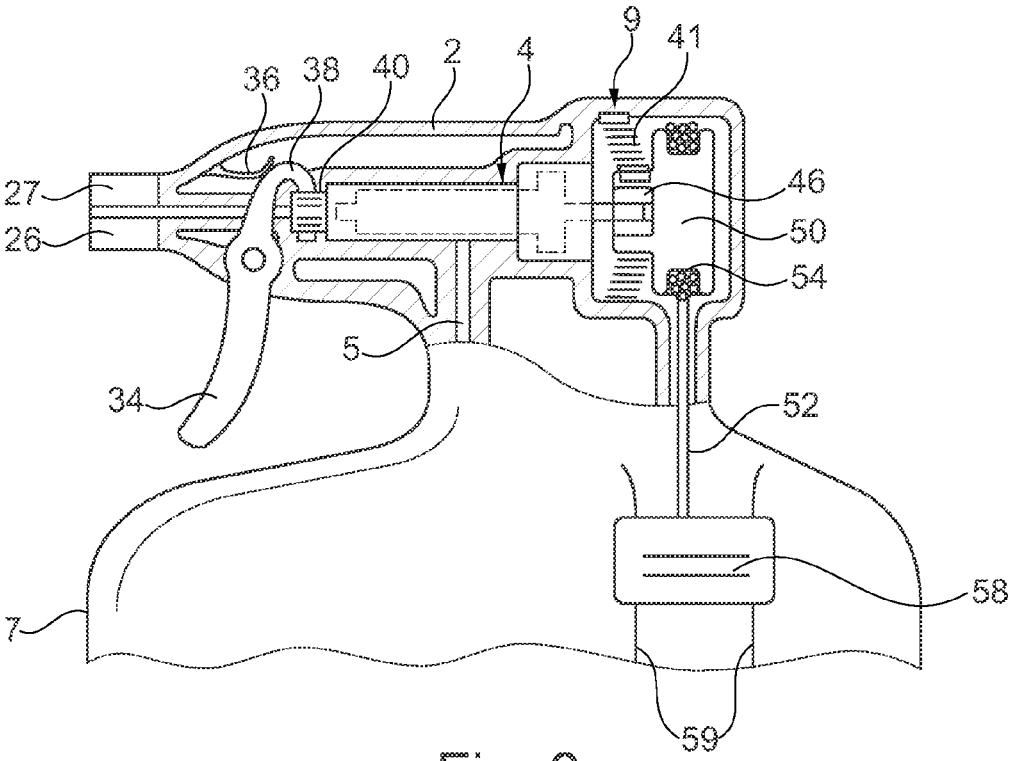
FIG. 3 is a schematic cross-sectional view through a dispenser head according to a third embodiment of the invention.

The embodiments of FIGS. 1, 2, and 3 comprise an energy storage mechanism 9, whereas the embodiments illustrated in FIGS. 4, 5, 6*a*, 6*b*, and 7*a*-7*f* do not comprise an energy storage mechanism, the fluid being dispensed by direct actuation by the user.

In the variants with an energy storage mechanism 9, the dispensing head comprises an actuation mechanism 3 that acts to block the rotor of the pump to prevent dispensing liquid, respectively to liberate the rotor to allow rotation in a pumping direction for dispensing liquid.

Referring first to the embodiment of FIG. 1, the actuation mechanism 3 comprises a manual actuation member 34 in the form of a button or lever biased into a braking or locking position by a spring 36, the actuation member 34 connected to a brake member 38 engagable with a braking portion 40 rigidly connected or integrally formed with the pump rotor 13. In a variant, the brake member 38 may comprise one or a plurality of protrusions that engage in complementary recesses formed in the braking portion 40 of the rotor. For instance, the braking portion 40 may be in the form of a toothed ring coaxially arranged around a periphery of a portion of the rotor. The teeth may have various shapes and sizes, it being understood that the force of the spring 36 is configured to provide a sufficient biasing force of the braking member 38 on the braking portion 40 to stop rotation of the rotor. Instead of inter-engaging teeth or protrusions, the inter-engaging actuator braking member 38 and rotor braking portion 40 may comprise other configurations including surfaces that engage solely or principally by friction. In certain applications, a friction operated braking mechanism may be advantageous in order to prevent very abrupt stopping of the pump rotor leading to excessive wear or rupture of inter-engaging teeth.

Instead of a biasing spring 36 acting on the actuation member, the actuation member 34 may be movable, by sliding or rotation, from a first closed position preventing fluid dispensing, to an open position liberating the pump rotor for dispensing fluid, by means of a complementary protrusion, latch, notch and groove, or other similar configuration that allows the actuation member to be mechanically switched from the open position to the closed position and vice versa. In another variant, the actuation member may be connected to a bi-stable spring element that allows the actuation member to be mechanically flipped from the open to the closed position and vice versa, and to remain stably in the open or closed position once actuated.

The energy storage mechanism 9 may advantageously comprise a mechanical spring, in particular a clock spring or other equivalent angular or spiral spring. The spring coil is connected at an outer end to a spring holder barrel 42 rotatably mounted in the housing 2, and is connected at an inner end to a rotor portion 44 fixed to or integral with the pump rotor 13.

In the embodiment of FIG. 1, the spring holder barrel 42 of the energy storage mechanism is coupled via freewheel 49 to the body portion, thus allowing biasing of the spiral spring 41. The bobbin portion 54 is coupled to a second freewheel 46 via shaft 51. When pulling the cord 52, the freewheel 46 locks on the drive shaft 51 and drives the spring holder barrel. The spring holder barrel remains in its position due to the freewheel 49. When releasing the cord 52, the bobbin portion 54 with the drive shaft 51 rotate back due to the spring 56 and the freewheel 46.

In the embodiment illustrated in FIG. 1, the rotatable loading member 50 is connected to an end of a cord 52 that is wound around a bobbin portion 54 of the rotatable loading member 50. The cord is connected at its other end to a manual loading grip 58 in the form of a handle accessible from the outside of the dispenser head housing 2 and adapted to be gripped by a user and pulled, in order to rotate the rotatable loading member 50 to energise the spring 41.

In the embodiment of FIG. 1, the energy storage loading mechanism comprises a second clock or spiral spring 56, connected at its inner end to the rotatable loading member 50 and connected at its outer end to a body portion 48 fixed to or integral with the housing 2. The second spring 56 is configured to be loaded as the cord 52 is being pulled, and when the handle 58 is released, the second spring 56 drives the rotatable loading member 50 to wind the cord 52 around the bobbin portion 54. As the cord 52 is being wound around the bobbin portion 54, the freewheel 46 allows free rotation of the rotatable loading member 50 with respect to the spring holder barrel 42 of the energy storage mechanism.

In the variant illustrated in FIG. 3, the energy storage mechanism comprises a mechanical spring, in particular a clock spring or other equivalent angular or spiral spring 41 connected at an outer end to a body portion fixed to or integral with the housing 2 and connected to the pump rotor 40.

In the embodiment of FIG. 3, the rotor portion 44 is part of the pump rotor 40 and connected to a rotatable loading member 50 via a freewheel 46 that is configured to allow free rotation of the loading member 50 relative to the pump rotor portion 44 in a direction loading (i.e. energising) the spring 41. In the opposite direction, corresponding to an unloading of the spring 41, the freewheel 46 is locked so that rotation of the rotor portion 44 driven by unwinding of the spring 41 drives the pump rotor 40. The energy storage loading mechanism comprises a handle 58 connected to a rotatable loading member 50 via a cord 52 that winds around a bobbin portion of a rotatable loading member 50. The variant of FIG. 3 differs from the variant of FIG. 1 in that there is no second spring provided to rewind the cord 52. Instead, the cord 52 is rewound around the rotatable loading member 50 during rotation of the pump rotor driven by unwinding of the energy storage mechanism spring 41. The handle 58 and/or cord 52 may optionally be guided by rails 59 extending along the container 7, whereby the position of the handle provides a useful visual indication of the loading (i.e. stored energy) state of the energy storage mechanism. The indication of the stored energy level is useful in applications where a continuous delivery of fluid is required without interruption, for example when spraying paint, or when administering a specified dose of fluid.

Referring to FIG. 2, in the embodiment illustrated, the energy storage mechanism is similar to the embodiment of FIG. 3 in that a clock or spiral spring 41 is connected to a rotor portion 44 coupled to the pump rotor via a freewheel. The outer end of the energy storage spring 41 is however connected to a manual loading grip 58' in the form of a wheel grip that is mounted rotatably to the housing 2 of the dispensing head 1. A ratchet mechanism 60 formed by inter-engaging teeth of the wheel grip 58' and housing 2 allows rotation of the wheel grip 58' with respect to the housing 2 in a loading direction that energises the clock spring 41, but that prevents rotation in the opposite direction. In order to store energy, the wheel grip 58' is thus rotated in the loading direction. The user can release the wheel grip 58' at any position whereby the ratchet mechanism blocks the wheel grip 58' to prevent unloading of the spring. The pump is actuated by pulling the actuation lever 34, thus releasing the brake 38, 40 and allowing rotation of the pump rotor driven by the spring 41, thus pumping fluid out of the nozzle 26. In the variant illustrated in FIG. 2, the manual loading grip 58' and the pump 4 may be coaxially aligned, and further substantially aligned with the nozzle 26, in a compact arrangement.

Referring to FIGS. 4 to 7*b*, embodiments of the invention without an energy storage mechanism will now be described.

Figure 4:
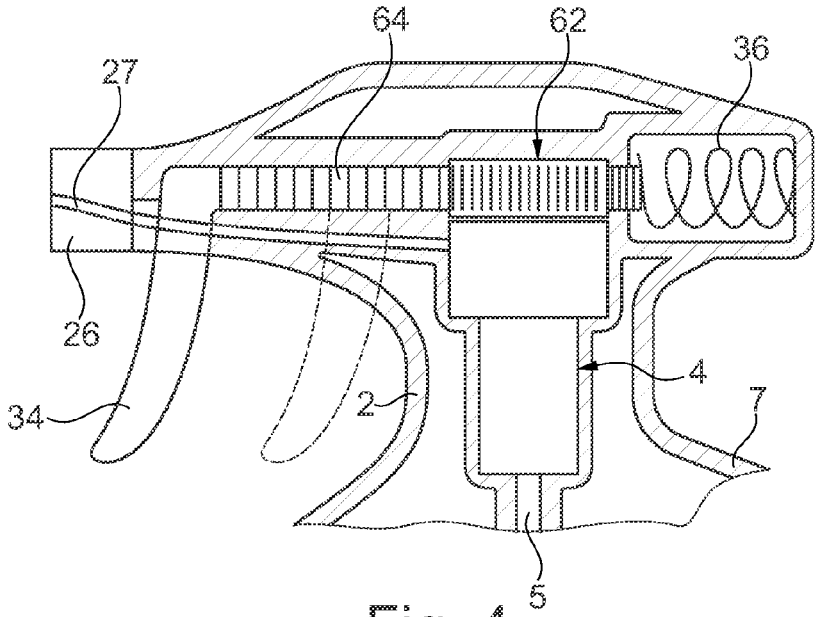
FIG. 4 is a schematic cross-sectional view through a dispenser head according to a fourth embodiment of the invention.

In the embodiment of FIG. 4, the rotor of the pump 4 is coupled to a pinion or gear wheel 62 that is coupled to the pump rotor via a freewheel similar to the freewheel 46 of the above described embodiment of FIG. 1. The freewheel is configured to allow free rotation of the gear wheel 62 relative to the pump rotor in a direction allowing return of the manual actuation member 34 to its initial position illustrated in bold lines in FIG. 4. The manual actuation member 34 comprises a linearly movable rack portion 64 that engages the teeth of the gear wheel 62 causing it to rotate in a rotor pumping direction when the lever 34 is pulled towards the container by the user. Fluid is thus dispensed through the nozzle outlet 27 during manual displacement of the actuation lever 34 by the user. The actuation member 34 acts against a spring 36 that is loaded (in this example compressed) when the pump is being driven and pushes back the manual actuation member 34 to its initial position, once the actuation member is released. During release, as mentioned above, the rotor of the pump does not turn because of the freewheel between the gear wheel 62 and the pump rotor.

The variant of FIG. 5*a* is similar to the variant of FIG. 4 in that an actuation member 34 in the form of a button connected to a rack portion 64 engages a gear wheel coupled to the rotor of the pump 4 via a freewheel. The difference in this variant is that the pump rotor axis is arranged essentially vertically and the actuation button is positioned at the top of the spray head housing 2 and may be pressed downwards in a vertical motion, whereas in FIG. 4 the rack is arranged horizontally and the rotor axis is essentially horizontal. The variants of FIGS. 5*b* and 5*c* are also similar to the variants of FIGS. 4 and 5*a*, except that the rack portion 64 is mounted on a manual actuation grip 34 that is pivotally mounted to the dispenser head housing, the rack portion extending from an end of a rotating lever arm portion 35 of the actuation grip.

The embodiments of FIGS. 6*b*, 7*a* and 7*b* are particularly well adapted for dispensing liquids in a non-aerosol manner, for example for dispensing cosmetic lotions, creams, or gels, or other relatively viscous fluid substances.

In the embodiments of FIGS. 6*a* and 6*b*, the pump 4 is mounted inside the container 7 and can be fully immersed in the fluid contained in the container. In the embodiment shown, the pump 4 is mounted at the bottom of the container. The pump has essentially the same configuration as the pump described in relation to FIG. 1, except that the pump rotor may optionally be connected to a gear wheel 62' by a direct connection (as opposed to via a freewheel) or via a freewheel as previously described. In the first option the gear wheel 62' may be integrally formed with the pump rotor or rigidly fixed to the pump rotor.

In the variant shown, the pump inlet 5 is configured as an orifice 5 in the stator of the pump which is immersed in the fluid, the orifice 5 being arranged close to the bottom wall 66 of the container. The pump outlet 28 is connected via a tube to the nozzle outlet 27 of the dispenser system. The dispenser system further comprises a pump manual actuation member 34' in the form of a ring rotatably mounted to the container and provided with gear teeth 61 on an inner side thereof, engaging the teeth of the gear wheel 62' of the pump. The gear wheel 62' of the pump actuation mechanism is positioned outside of the container 7 and in the embodiment shown below the bottom wall 66. In this configuration, the pump is fixed to and extends through a bottom wall 66 of the container. The pump may either form a functional separate unit assembled to the container 7, or the stator of the pump may be integrally formed with the container bottom wall 66 as illustrated in FIG. 6*b*, the pump rotor being assembled in the part of the bottom wall forming the pump stator. In the latter configuration, the cam mechanism 30 defining the rotor axial displacement as a function of rotor rotation may comprise a cam element 32*a* on the bottom wall 66 of the housing, and a cam element 32*b* on the base of the ring shaped manual actuation member. The ring shaped manual actuation member 34' is rotatably mounted to the container housing substantially at or below the bottom wall 66 and may be rotated by the user relative to the container housing, in order to rotate the pump rotor via the gear wheel 62' in order to dispense fluid. Optionally the manual actuation member 34' may engage the container with a ratchet to ensure rotation in only one direction, such option being useful where the gear wheel 62' is rigidly connected to the pump rotor.

The user can thus dispense small amounts of fluid with fine control and can easily stop dispensing with immediate effect by stopping rotation of the ring 34'. In pressurized systems or dispensers where tubes or containers are squeezed, it is much more difficult to control immediate stopping of dispensing.

Referring to the embodiment of FIGS. 7*a* to 7*f*, the function in principle is similar to the embodiment of FIG. 4 in that the actuation mechanism comprises a manual actuation member in the form of actuation buttons 34*a*, 34*b*, each provided with a rack portion 64 disposed on opposite sides of a gear wheel 62 connected to the rotor of the pump via a freewheel as described in relation to the embodiment of FIG. 4 or via a ratchet mechanism. The return springs 36*a* and 36*b* are positioned between the opposed actuation buttons 34*a*, 34*b* which can be pressed towards each other, as shown in FIG. 7*f*, by a squeezing action between thumb and forefinger of the human operator. As the buttons are released, and pushed back by the springs to their initial position, as shown in FIG. 7*e*, the gear wheel 62 turns freely with respect to the pump rotor in view of the freewheel coupled between, as already described above in relation to the variants of FIG. 4.

In this variant, the nozzle 26 may be arranged adjacent, for instance above, the manual actuation member 34, but it would also be possible to have the dispensing nozzle arranged at an opposite end of the container to the pump and actuation buttons by connecting the nozzle via a tube to the outlet of the pump, for example in a manner similar to the tube shown in the embodiments of FIGS. 6*a*, 6*b*.

LIST OF REFERENCES

Dispensing System
7 container
  5 inlet
  6 inside reservoir
  59 handle guide rail
  66 bottom wall
26 nozzle
  27 nozzle outlet
8 fluid
1 dispensing head
  2 housing
  4 pump
    13 pump rotor
      17, 18 rotor extensions
    12 pump stator
      15, 16 chambers
    40 brake portion
    28 pump outlet
    19, 20 seals
    22, 24 liquid supply channels
    30 axial movement mechanism→cam mechanism
      31 rotor cam
      32*a* stator cam element/surface for pumping action
      32*b* stator cam element/surface for drawing in action
  3 pump actuation mechanism
    34 manual actuation member→button or lever or grip
      38 brake member
      35 lever arm
    34' manual actuation member→rotatable ring
    36 spring
    62, 62' gear wheel
    61 gear ring
    64 gear rack
  9 energy storage mechanism
    41 spring→spiral spring
    42 spring holder barrel
    44 rotor portion
    46 freewheel
    49 freewheel
  10 loading mechanism
    48 body portion
    50 rotatable loading member
      51 drive shaft
      54 bobbin portion
    52 cord
    56 spring→second spiral spring
    58 manual loading grip→handle or wheel grip

The invention claimed is:

1. A manually energized dispensing system for dispensing a fluid contained in a non-pressurized container, the dispensing system comprising a nozzle through which fluid to be dispensed exits, a dispensing head comprising a housing, a pump mounted in the housing, and a pump actuation mechanism, the pump comprising a rotor rotatable and axially displaceable with respect to a stator, the rotor comprising first and second axial extensions of different diameters, mounted in corresponding chambers of the stator, first and second seals mounted in the stator housing and sealingly surrounding the first and second axial rotor extensions, the rotor extensions comprising liquid supply channels that, in conjunction with the sealing rings, operate as valves that open and close communication between an inlet of the pump connected to the inside of the container and the pump chambers, respectively, the pump chambers and an outlet of the pump connected to the dispensing head nozzle, as a function of the angular displacement of the pump rotor, characterized in that the pump rotor is coupled mechanically to the actuation mechanism and the actuation mechanism is configured to be manually operated to release or to drive the pump rotor to dispense fluid or to block the pump rotor to stop dispensing fluid, respectively, and the dispensing system comprises an energy storage mechanism coupled to the pump rotor, and a manually actuable energy storage loading mechanism coupled to the energy storage mechanism.

2. The dispensing system according to claim 1, wherein the rotor and stator comprise complementary cam mechanisms defining the axial displacement of the rotor in opposing axial directions (A1, A2) as a function of angular displacement of the rotor, the axial directions defining a pumping action and a pump filling action.

3. The dispensing system according to claim 1, wherein the energy storage mechanism comprises a spiral spring coupled at an inner end to a rotor portion coupled to the pump rotor, and at an outer end to a spring holder barrel mounted rotatably in a freewheel in the dispenser head housing.

4. The dispensing system according to claim 1, wherein the loading mechanism comprises a cord connected at one end to a rotatable loading member coupled to the pump rotor and connected at the other end to a manual loading grip in the form of a handle, the cord being windable around the rotatable loading member.

5. The dispensing system according to claim 1, wherein the loading mechanism comprises a manual loading grip in the form of a wheel grip rotatably mounted over a freewheel to the housing and connected to the spring.

6. The dispensing system according to claim 1, wherein the energy storage mechanism comprises a spiral spring coupled at an inner end to a rotor portion coupled to the pump rotor, and at an outer end to a housing portion fixed to, or integral with, the dispenser head housing.

7. The dispensing system according to claim 6, wherein the spring is coupled to the pump rotor via a freewheel allowing free rotation of the rotor portion during loading of the spring, respectively, locking the rotor portion to the pump rotor during unloading of the clock spring.

8. The dispensing system according to claim 1, wherein the pump actuation mechanism comprises a manual actuation member comprising a brake member engagable with a complementary brake portion of the pump rotor configured to block the rotor when the actuation mechanism is in a position to stop dispensing fluid, respectively, release the pump rotor when the actuation mechanism is in a position to dispense fluid.

9. The dispensing system according to claim 8, wherein the brake member and complementary brake portion comprise inter-engaging teeth or protrusions.

10. The dispensing system according to claim 8, wherein the pump actuation mechanism comprises a spring configured to elastically bias the brake member towards the complementary brake portion to block the rotor when the actuation mechanism is released.

11. The dispensing system according to claim 10 wherein the pump is disposed in the container.

12. The dispensing system according to claim 11 wherein the pump is disposed at or proximate a bottom wall of the container.

13. The dispensing system according to claim 12 wherein the stator of the pump is formed integrally with the bottom wall of the container.

14. The dispensing system according to claim 12 wherein the rotor and stator of said pump comprise complementary cam mechanisms defining the axial displacement of the rotor in opposing axial directions (A1, A2) as a function of angular displacement of the rotor, the axial directions defining a pumping action and a pump filling action, and wherein the stator cam mechanism comprises a cam element formed integrally with the bottom wall of the housing and a cam element formed integrally with the manual actuation mechanism.

15. A manually energized dispensing system for dispensing a fluid contained in a non-pressurized container, the dispensing, system comprising a nozzle through which fluid to be dispensed exits, a dispensing head comprising a housing, a pump mounted in the housing, and a pump actuation mechanism, the pump comprising a rotor rotatably and axially displaceable with respect to a stator, the rotor comprising first and second axial extensions of different diameters, mounted in corresponding chambers of the stator, first and second seals mounted in the stator housing and sealingly surrounding the first and second axial rotor extensions, the rotor extensions comprising liquid supply channels that, in conjunction with the sealing rings, operate as valves that open and close communication between an inlet of the pump connected to the inside of the container and the pump chambers, respectively, the pump chambers and an outlet of the pump connected to the dispensing head nozzle, as a function of the angular displacement of the pump rotor, characterized in that the pump rotor is coupled mechanically to the actuation mechanism and the actuation mechanism is configured to be manually operated to release or to drive the pump rotor to dispense fluid or to block the pump rotor to stop dispensing fluid, respectively, and wherein the actuation mechanism is coupled to the pump rotor and configured to directly drive the pump rotor to dispense fluid during manual actuation of the actuation mechanism.

16. The dispensing system according to claim 15, wherein the pump rotor is coupled to a gear wheel engaged by a complementary gear of the pump actuation mechanism, the complementary gear being connected to and actuated by a manual actuation member of the pump actuation mechanism.

17. The dispensing system according to claim 16, wherein the gear wheel is coupled to the pump rotor via a freewheel.

18. The dispensing system according to claim 16, wherein the complementary gear of the pump actuation mechanism is in the form of a rack.

19. The dispensing system according to claim 16, wherein the complementary gear of the pump actuation mechanism is in the form of a gear wheel or ring.

* * * * *